United States Patent [19]

Akell et al.

[11] 4,211,638

[45] Jul. 8, 1980

[54] NAPHTHA STRIPPING

[75] Inventors: Robert B. Akell, Wilmington, Del.; Werner C. Muller, Dobbs Ferry, N.Y.; Rudolph Pick, Metuchen, N.J.

[73] Assignee: Syngas Company, Deer Park, Tex.

[21] Appl. No.: 876,678

[22] Filed: Feb. 10, 1978

[51] Int. Cl.[2] ..... C10G 7/00; C10G 21/00

[52] U.S. Cl. ..... 208/180; 48/212; 208/185; 208/186; 210/21

[58] Field of Search ..... 208/180, 184, 186, 298, 208/185; 210/21; 48/212

[56] References Cited

U.S. PATENT DOCUMENTS

| | | | |
|---|---|---|---|
| 2,992,906 | 7/1961 | Guptill et al. | 48/196 |
| 3,473,903 | 10/1979 | Paull et al. | 48/196 R |
| 3,694,355 | 9/1972 | Visser et al. | 210/21 |
| 3,917,569 | 11/1975 | Richter et al. | 210/21 |

*Primary Examiner*—Herbert Levine

[57] ABSTRACT

Naphtha is recovered from a soot-naphtha slurry by mixing the slurry with hot residual oil and feeding the mixture into a vapor/liquid contactor. Within the contactor, part of the naphtha is vaporized. The remainder is withdrawn from the base, heated and sent to a stripping column where the naphtha is vaporized overhead as a superheated vapor and the soot-residual oil is removed from the bottom. The superheated naphtha vaporized overhead is recycled to the contactor where the superheat is used to vaporize liquid naphtha. The naphtha vapor leaving as overhead from the contactor is sent to a wash column where entrained residual oil is removed by naphtha reflux. The naphtha vapor in the wash column is taken off overhead and condensed. The condensed, liquid naphtha is then totally or partially fed to the wash column as reflux.

8 Claims, 1 Drawing Figure

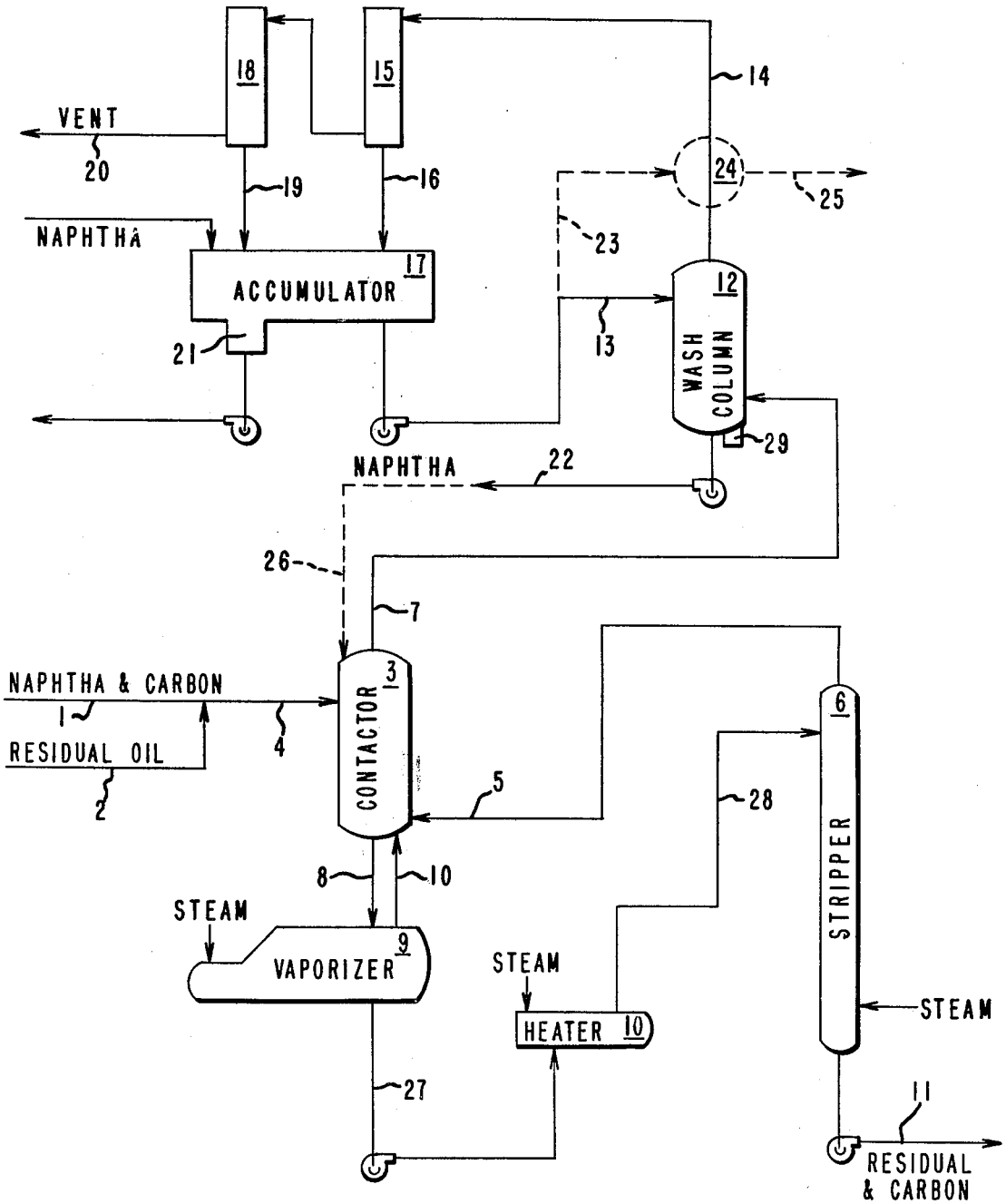
18
15
14
VENT
20
19
16
24
25
NAPHTHA
23
ACCUMULATOR
17
12
WASH COLUMN
21
13
29
NAPHTHA
22
26
7
NAPHTHA & CARBON
1
RESIDUAL OIL
2
4
CONTACTOR
3
5
6
STRIPPER
28
8
10
STEAM
VAPORIZER
9
STEAM
HEATER
10
STEAM
27
11
RESIDUAL & CARBON

NAPHTHA STRIPPING

BACKGROUND OF THE INVENTION

Processes have been developed for the partial combustion of various liquid and gaseous hydrocarbons, e.g., methane, residual oil, etc., with an oxygen-containing gas to produce synthesis gas, i.e., a gas containing primarily hydrogen and carbon monoxide. The product synthesis gas contains significant amounts of free carbon in the form of soot, particularly when heavy hydrocarbons are employed as feedstock. Various processes have been developed for the separation and recovery of this soot. One method involves scrubbing the product gas with water to produce a water-soot slurry. The slurry is then treated with a light hydrocarbon oil, e.g., naphtha, to produce a phase separation, i.e., water and naphtha-soot phases. The naphtha-soot phase is then treated to separate and recover the naphtha and soot. Descriptions of such processes can be found in U.S. Pat. Nos. 2,992,906; 3,473,903; 3,694,355 and 3,917,569.

In a naphtha recovery process used in the art the naphtha-soot slurry is mixed with a heavy liquid hydrocarbon, e.g., residual oil, heated, then distilled, e.g., by steam stripping, and condensed to recover the naphtha. The bottoms, a residual oil-soot slurry can then be recycled as the raw material for the partial oxidation process. Further details on this naphtha recovery process can be found in U.S. Pat. No. 3,473,903.

When the art process is used with heavy hydrocarbon liquids such as residual oil, several problems occur. The energy requirements of the process are high because the residual oil must be heated above the normal boiling temperature of the naphtha to reduce the naphtha content of the stripper bottoms. Furthermore, most of the superheat present in the naphtha vapors is not utilized; and this results in a loss of useable energy. Finally, entrained residual oil may cause fouling of conventional heat exchanger surfaces in the system.

SUMMARY OF THE INVENTION

The prior art process has been improved by feeding the mixture of hot, heavy and light hydrocarbon liquids and soot, under pressure, into a direct liquid/vapor contactor prior to introducing the mixture into the stripper. In the contactor the light hydrocarbon liquid is vaporized partly due to a reduction in pressure and partly by contact with the superheated vapors from the stripping column and a vaporizer or preheater. This method vaporizes part of the light hydrocarbon liquid without causing fouling of the vessel surfaces.

Secondly, the vapor overhead from the contactor is fed into a wash column where it is contacted with condensed light hydrocarbon liquid. This contact heats the light hydrocarbon liquid and scrubs any retained heavy hydrocarbon from the vapors. The bottoms from the wash column can be returned to the contactor or a decanter for reuse.

The process of the invention thus utilizes the sensible heat of the hot heavy hydrocarbon liquid and that of the superheated light hydrocarbon vapors, thus attaining considerable energy savings without fouling of heat exchanger surfaces.

DESCRIPTION OF THE DRAWING

The FIGURE is a flow diagram of an embodiment of the process of the invention.

DETAILED DESCRIPTION OF THE INVENTION

The process of the invention is applicable to the recovery of various light hydrocarbon liquids, such as naphtha, gasoline, benzol, heptanes, oxygenated hydrocarbons, and the like; however, since naphtha is the preferred light liquid for use, the following description will be directed to that preferred embodiment.

Various heavy hydrocarbon liquids can be used in the process of the invention; thus any of the present feedstocks for partial oxidation processes can be used, residual oil, heavy distillates, bunker oil, No. 6 fuel oil, vacuum pitch, and the like. The advantages of the process of the invention are obtained when the very heavy liquids are used. Thus the following description will be directed to the use of residual oil, the preferred heavy hydrocarbon liquid.

Referring to the FIGURE, a slurry 1 of naphtha and soot is mixed with a stream of residual oil 2. The amount of residual oil added to the slurry is not critical, and it will vary from 30 to 80 percent by weight of the mixture. The mixture is then fed into a contactor 3.

In most embodiments of the invention the naphtha-soot slurry will be supplied as the overhead from a naphtha-soot/water decanter; and it will contain water, i.e., from 1 to 10 percent by weight water. The slurry will have a temperature of 90° to 140° C. and will be under pressure, typically 50 to 300 psig. The residual oil added to the slurry will also be heated and under pressure, typically 150° to 250° C. and 50 to 300 psig.

Within the contactor 3 the liquid mixture 4 is in direct contact with countercurrent, superheated naphtha vapors 5 from the naphtha stripper 6. These vapors are at a temperature of 150° to 300° C., preferably 230° to 270° C. and under a pressure of 10 to 100 psig, preferably 25 to 50 psig. Superheated naphtha vapors 10 from the vaporizer 9 also can be used to vaporize naphtha. These vapors 10 are at a temperature of 150° to 250° C., preferably 180° to 220° C. Note, the term "superheated" means that the vapor temperature of the stream is considerably higher than that of its boiling point at the pressure involved.

As a result of this direct contact and the pressure reduction, part of the naphtha in the mixture is flashed off and leaves the contactor as overhead 7 with the naphtha vapors 5 from the stripper 6. Typically, 30 to 60 percent by weight of the naphtha in the mixture will be flashed off in the contactor. This overhead vapor 7 will contain naphtha, water and some entrained residual oil. In some embodiments, which will be subsequently described, the bottoms 26 from wash column 12 will be used as reflux in the contactor.

The contactor can be any direct liquid/vapor contactor that can accommodate the feedstream involved.

The bottoms 8 from the contactor will contain the remaining naphtha-residual oil-soot mixture. This mixture is fed into a vaporizer 9 where it is heated by steam and additional naphtha is flashed off 10 as superheated vapor and is fed back into the contactor countercurrent to the liquid mixture. The remaining naphtha-residual oil-soot 27 is then further heated to a temperature suitable for stripping of the naphtha from the residual oil-soot, i.e., 200° to 300° C. in a suitable heater 10.

The vaporizer 9 can be a separate vessel as illustrated in the FIGURE or it can be located directly below the contactor 3. The heater 10 can be any conventional reboiler and one employing steam has been illustrated.

In some embodiments both the vaporizer and the heater will not be necessary, only one unit capable of increasing the temperature of the mixture will be employed.

The heated mixture 28 is then fed into the naphtha stripper 6 wherein the naphtha is stripped from the mixture, e.g., by a countercurrent flow of steam.

From the bottom of the stripper 6 a stream 11 of residual oil and soot are withdrawn. This stream can be recycled back to the partial oxidation unit as feedstock or otherwise disposed of.

The superheated vapors 5 from the top of the stripper are fed into the contactor 3 as previously described.

The overhead 7 from the contactor 3 is fed into the bottom of the wash column 12. This overhead contains water, typically 1 to 10 percent by weight; naphtha, typically 90 to 99 percent by weight; and entrained residual. This stream has a temperature between 110° and 170° C. and a pressure between 10 and 100 psig.

In the wash column the vapors are directly contacted with a countercurrent flow of liquid naphtha 13. This liquid naphtha is at a temperature between 30° and 80° C.; and when it contacts the vapors, it removes entrained residual oil and is heated.

The vapors, after being partially cooled by the liquid naphtha, are removed overhead 14. These vapors are at a temperature of 100° to 150° C. and typically contain 1 to 10 percent by weight water vapor. The overhead is then fed into a water-cooled condenser 15 which cools it to a temperature of 30° to 60° C. At this temperature most of the naphtha is condensed and flows 16 into an accumulator 17. The remaining vapors are fed into a brine-cooled condenser 18 which further cools the vapors to 5° C. The condensed liquids from this condenser are fed into the accumulator 17 through conduit 19. The remaining vapors are vented 20 or sent for further treatment. If desired or necessary, naphtha makeup can be added to the accumulator as illustrated.

In the accumulator the water present settles in the sump 21 and is pumped away for reuse or discharge to waste. The liquid naphtha is then fed into the wash column through line 13 as previously explained.

The liquid bottoms 22 of the wash column, essentially pure naphtha, possibly containing some residual oil and water, is then pumped away for storage or resue, e.g., it can be recycled to the decanter (not shown). In some embodiments it may be desirable to provide the wash column with a sump 29 wherein water can collect and be discarded.

The dotted lines on the FIGURE illustrate another embodiment that can be employed in the event any traces of residual oil in the naphtha 22 would create a problem, i.e., in the decanter.

In this embodiment only a portion of the naphtha 13 from the accumulator is fed into the wash column 12 to directly contact the vapors. The other portion 23 is fed into a heat exchanger 24 where it is heated by the overhead vapors from the wash column. The thus heated naphtha 25 is practically free from any retained residual oil and is then drawn off for storage or reuse.

The liquid bottoms 26 from the wash column in this embodiment would be fed back into the contactor 3 where they and the mixture 4 would be contacted by the countercurrent flow of vapors from the stripper 6.

In another embodiment, not illustrated, the entire naphtha feed stream 13 can be fed into the wash column. However, the wash column would have two draw-offs, one in the upper to middle part of the column to remove essentially pure naphtha and one at the bottom which would remove the naphtha containing residual oil. The bottom draw-off would then be recycled to the top of the contactor as reflux. The upper draw-off may be further treated to remove any water present by allowing the liquid to settle in a drum or accumulator.

The following example illustrates how one skilled in the art could operate an embodiment of the process of the invention.

EXAMPLE

A stream of 28,250 parts per hour of a naphtha-soot-water slurry 1 from a decanter and at 130° C. and a pressure of 250 psig is mixed with 13,250 parts per hour of residual oil 2 having a temperature of 220° C. and a pressure of 250 psig. The resulting mixture 4 has a temperature of 160° C. and is flashed into a contactor 3.

At the same time about 1,750 parts per hour of naphtha-water vapor 5 at a temperature of 254° C. and a pressure of 30 psig enter the bottom of the contactor.

Below the contactor is located a vaporizer. 7,500 Parts per hour of steam at 340 psig is supplied to this vaporizer. This causes some of the naphtha to vaporize.

The vapors from the vaporizer 10 and the stripper 5 rise through the contactor causing some naphtha to flash. The overhead 7 from the contactor has a temperature of 123° C. and consists of 28,500 parts per hour of naphtha, water (1,500 parts per hour) and some entrained residual oil.

The bottoms from the vaporizer consist of 14,750 parts per hour of residual oil, 700 parts per hour of soot, and 1,100 parts per hour of naphtha. This stream has a temperature of 196° C. and is heated to 258° C. by a heater 10.

The heated stream 28 is then fed into the stripper 6 to which steam is added at the rate of 500 parts per hour to assist in stripping the naphtha from the residual oil.

The residual oil-soot slurry 11 leaves the stripper free from naphtha and the vapors 5 are fed into the contactor 3.

The wash column receives the overhead 7 from the contactor and also 29,000 parts per hour of naphtha 13 at 60° C. The bottom stream from the wash column 22 is drawn off at the rate of 28,000 parts per hour and recycled to the decanter. This embodiment can be employed if the minor amounts of entrained residual oil in the naphtha will not create a problem in the decanter.

If the entrained residual oil could cause a problem, the bottoms from the wash column 26 could be used as reflux in the contactor at the rate of 1,250 parts per hour. In this embodiment only part of the condensed naphtha is fed into the wash column, 2,000 parts per hour. The remainder 27,000 parts per hour, is fed to a heat exchanger 24 where it is heated to 118° C. by the overhead vapors 14 from the wash column. The heated naphtha is then fed to the decanter.

We claim:

1. In a process for recovering a light hydrocarbon liquid from a slurry of the light liquid with soot by mixing the slurry with a heavy hydrocarbon liquid, then heating and distilling the mixture in a naphtha stripper with the light liquid taken off overhead and condensed while drawing off a bottom stream composed of the heavy liquid and soot, the improvement comprising, after mixing the slurry with the heavy hydrocarbon liquid but prior to distilling the mixture in the naphtha stripper, feeding the mixture under pressure into a direct liquid-vapor contactor where the mixture is contacted with superheated, overhead vapors from the naphtha stripper, thereby converting part of the light hydrocarbon liquid into vapor, the vapors being taken off overhead and condensed, and removing the remainder of the liquid mixture from the bottom of the contactor and feeding it to the stripper.

2. The process of claim 1 wherein the light liquid is naphtha and the heavy liquid is residual oil.

3. In a process for recovering a light hydrocarbon liquid from a slurry of the light liquid with soot by mixing the slurry with a heavy hydrocarbon liquid, then heating and distilling the mixture in a naphtha stripper with the light liquid taken off overhead and condensed while drawing off a bottom stream composed of the heavy liquid and soot, the improvement comprising, after mixing the slurry with the heavy hydrocarbon liquid but prior to distilling the mixture in the naphtha stripper, feeding the mixture under pressure into a direct liquid-vapor contactor where the mixture is contacted with superheated, overhead vapors from the naphtha stripper, thereby converting part of the light hydrocarbon liquid into vapor, the vapors being taken off overhead and condensed, and removing the remainder of the liquid mixture from the bottom of the contactor and feeding it to the stripper and prior to condensing the overhead vapors from the contactor, feeding the vapors into a wash column where they are contacted with condensed light hydrocarbon liquid to remove entrained heavy hydrocarbon.

4. In a process for recovering a light hydrocarbon liquid from a slurry of the light liquid with soot by mixing the slurry with a heavy hydrocarbon liquid, then heating and distilling the mixture with the light liquid taken off overhead and condensed while drawing off a bottom stream composed of the heavy liquid and soot, the improvement comprising (a) feeding the mixture of light hydrocarbon liquid, heavy hydrocarbon liquid and soot under pressure into a direct liquidvapor contactor where the mixture is contacted with the superheated, overhead vapors from a naphtha stripper, thereby converting part of the light hydrocarbon liquid into vapor, (b) removing the remainder of the liquid mixture from the contactor and heating it to a temperature suitable for separating the remaining light hydrocarbon liquid from the heavy hydrocarbon liquid, (c) feeding the heated mixture into a stripper wherein the light hydrocarbon liquid is stripped from the mixture, taken off overhead as superheated vapors, and fed into the contactor of step (a), and a heavy hydrocarbon liquid-soot slurry is taken off from the bottom of the stripper, (d) feeding the vapor overhead from the contactor of step (a) into a wash column where it is contacted with condensed light hydrocarbon liquid from step (e), (e) condensing the overhead from the wash column, separating any water present from the light hydrocarbon liquid and feeding the condensed light hydrocarbon liquid into the wash column, and (f) drawing off a light hydrocarbon liquid stream from the wash column for storage or use.

5. The process of claim 4 wherein the light liquid is naphtha and the heavy liquid is residual oil.

6. In a process for recovering a light hydrocarbon liquid from a slurry of the light liquid with soot by mixing the slurry with a heavy hydrocarbon liquid, then heating and distilling the mixture with the light liquid taken off overhead and condensed while drawing off a bottom stream composed of the heavy liquid and soot, the improvement comprising (a) feeding the mixture of light hydrocarbon liquid, heavy hydrocarbon liquid and soot under pressure into a direct liquidvapor contactor where the mixture is contacted with the superheated, overhead vapors from a naphtha stripper, thereby converting part of the light hydrocarbon liquid into vapor, (b) removing the remainder of the liquid mixture from the contactor and heating it to a temperature suitable for separating the remaining light hydrocarbon liquid from the heavy hydrocarbon liquid, (c) feeding the heated mixture into a stripper wherein the light hydrocarbon liquid is stripped from the mixture, taken off overhead as superheated vapors, and fed into the contactor of step (a), and a heavy hydrocarbon liquid-soot slurry is taken off the bottom of the stripper, (d) feeding the vapor overhead from the contactor of step (a) into a wash column where it is contacted with a portion of the condensed light hydrocarbon liquid from step (e), the liquid bottoms from the wash column being recycled to the contactor and the vapor being taken off overhead, (e) condensing the overhead from the wash column, separating any water present from the light hydrocarbon liquid, separating the light hydrocarbon liquid into two parts, one part being fed into the wash column and the other part being removed for storage or use.

7. The process of claim 6 wherein the light liquid is naphtha and the heavy liquid is residual oil.

8. The process of claim 6 wherein the part of the light hydrocarbon liquid removed for storage or use in step (e) is first fed into a heat exchanger to cool the overhead from the wash column.

* * * * *